US007935905B2

(12) United States Patent
Puri et al.

(10) Patent No.: US 7,935,905 B2
(45) Date of Patent: May 3, 2011

(54) CONTACT SYSTEM

(75) Inventors: Werner Puri, Nürnberg (DE); Joachim Seidl, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 504 days.

(21) Appl. No.: 11/660,728

(22) PCT Filed: Aug. 12, 2005

(86) PCT No.: PCT/EP2005/053967
§ 371 (c)(1),
(2), (4) Date: Oct. 15, 2008

(87) PCT Pub. No.: WO2006/021518
PCT Pub. Date: Mar. 2, 2006

(65) Prior Publication Data

US 2009/0229956 A1 Sep. 17, 2009

(30) Foreign Application Priority Data

Aug. 23, 2004 (EP) ..... 04019974

(51) Int. Cl.
*H01H 5/22* (2006.01)

(52) U.S. Cl. ..... 200/447

(58) Field of Classification Search ..... 200/16 R–16 D, 200/405, 408, 409, 447–452
See application file for complete search history.

(56) References Cited

U.S. PATENT DOCUMENTS

| | | | | | |
|---|---|---|---|---|---|
| 2,571,453 | A | * | 10/1951 | Jackson | 200/1 B |
| 2,629,791 | A | | 2/1953 | Le Tourneau et al. | |
| 2,884,503 | A | * | 4/1959 | Connelly | 200/345 |
| 3,061,694 | A | * | 10/1962 | Carlson | 200/448 |
| 3,354,274 | A | * | 11/1967 | Bauer | 200/447 |
| 3,449,534 | A | * | 6/1969 | Bauer | 200/452 |
| 3,814,872 | A | * | 6/1974 | Magerman | 200/33 R |
| 3,994,483 | A | * | 11/1976 | Perucchi et al. | 267/160 |
| 4,050,044 | A | * | 9/1977 | Fischer et al. | 337/137 |
| 4,254,313 | A | * | 3/1981 | Baader | 200/452 |
| 4,365,123 | A | | 12/1982 | Baader et al. | |
| 4,891,481 | A | * | 1/1990 | Comerford | 200/409 |
| 6,483,058 | B2 | * | 11/2002 | Ehrensberger | 200/302.2 |
| 2002/0033323 | A1 | | 3/2002 | Ehrensberger | |

FOREIGN PATENT DOCUMENTS

| | | |
|---|---|---|
| DE | 35 31 390 C1 | 10/1986 |
| DE | 3531390 C1 | 10/1986 |
| FR | 2 329 171 | 10/1976 |
| FR | 2329171 A | 5/1977 |

* cited by examiner

*Primary Examiner* — Michael A Friedhofer
(74) *Attorney, Agent, or Firm* — Harness, Dickey & Pierce, P.L.C.

(57) ABSTRACT

A contact system is disclosed for use in electromechanical switchgear. In at least one embodiment of the invention, a contact system is provided which has a simple constructive design and allows for an especially reliable contact. For this purpose, at least one embodiment of the contact system includes a spring support, an actuating element, and a contact element. The contact element includes a spring area, supported on the spring support, for providing a jump function, an actuator area, actuated by the actuating element, for initiating the jump function, and a contacting area for simultaneously establishing electrical contact with the stationary contact pieces.

15 Claims, 4 Drawing Sheets

CONTACT SYSTEM

PRIORITY STATEMENT

This application is the national phase under 35 U.S.C. §371 of PCT International Application No. PCT/EP2005/053967 which has an International filing date of Aug. 12, 2005, which designated the United States of America and which claims priority on German Patent Application number 04019974.7 filed Aug. 23, 2004, the entire contents of which are hereby incorporated herein by reference.

FIELD

Embodiments of the invention generally relate to a contact system for use in electromagnetic switchgear, for example contactors, position switches, command and feedback devices and contactor combinations or the like.

BACKGROUND

A known contact system has both a fixed contact and a moving contact. The fixed contact in this case serves to make contact with a connecting line or the like. The moving contact serves to open and close the contact system.

The switch systems known from the prior art have a contact support region and a jump mechanism or a creep mechanism. In this case, the contact support region serves to mount, guide and actuate the moving contact. The jump mechanism serves to convert the linear actuation of the switch by way of an actuating element into an automatic and irreversible jump actuation of the contact support region, by which the actual switching operation is carried out. Contact support region and jump mechanism include a large number of components, which results in high costs in development, fabrication and assembly and increases the risk of failure of the subassembly.

U.S. Pat. No. 4,254,313 discloses a snap-action switch which has a snap-action spring which is fixed to a carrier, the snap-action switch having at least one snap-action contact which connects the former electrically to the carrier. The snap-action switch has at least two arms, which are under reciprocal tension in order to form a closed system of forces in which at least one arm is under compressive bending and can be switched by way of an external actuating force.

SUMMARY

At least one embodiment of the present invention permits reliable contact making with a particularly simple constructional design.

In at least one embodiment, the contact system has a spring holder, an actuating element and a contact element, the contact element having a spring region mounted on the spring holder in order to provide a jump function, and an actuating region that can be actuated by the actuating element in order to initiate the jump function, and a contact-making region for the simultaneous production of an electric contact with the fixed contact pieces.

It is a central idea of at least one embodiment of the invention to integrate the jump function and the contact-making function in a single component, the contact element. By way of this functional integration, the number of components needed is reduced considerably. This leads to lower material, assembly and fabrication costs and additionally reduces the risk of failure of the subassembly. In addition, a reduction in the overall sizes of the individual system components is also possible, which means that a considerable reduction in the overall space required for the contact system can be achieved. The reduction in the number of components and thus the fabrication tolerances of the component pairings prevent erroneous positioning of the moving contact and, as a result, counteract functional impairment.

Expediently, the contact element is composed of an elastically deformable material or material composite, for example spring steel or copper-plated spring steel. This permits, firstly, the jump function of the contact element and, secondly, an adequate contact-making pressure in the switching positions.

In an example embodiment of the invention, the spring holder is formed as part of a housing enclosing the contact element. The spring holder in the shape of an additional individual component can therefore be dispensed with, which leads to a further constructional simplification.

An embodiment of the invention in which the spring region is pre-embossed in order to achieve an asymmetrical jump behavior has proven to be particularly advantageous. In this case, this can be embossing both on one side and on both sides.

BRIEF DESCRIPTION OF THE DRAWINGS

The present invention will be described in more detail below by using example embodiments, which will be explained with the aid of the drawings, in which.

DETAILED DESCRIPTION OF THE EXAMPLE EMBODIMENTS

Figure 1:
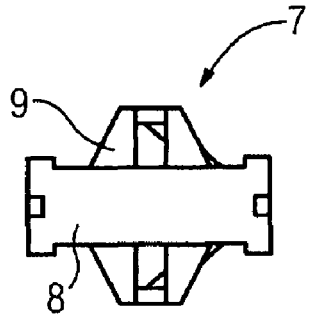
FIG 1 Prior Art
FIGS. 1-3 show a schematic illustration of a contact system according to the prior art.
Figure 2:
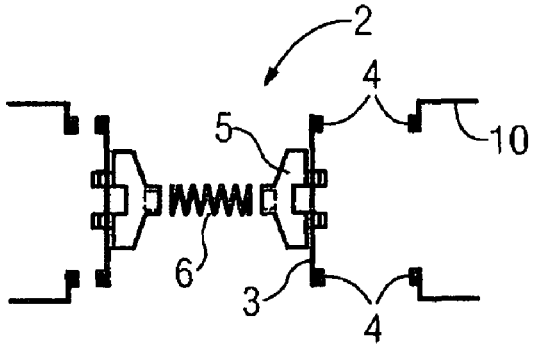
FIG 2 Prior Art
Figure 3:
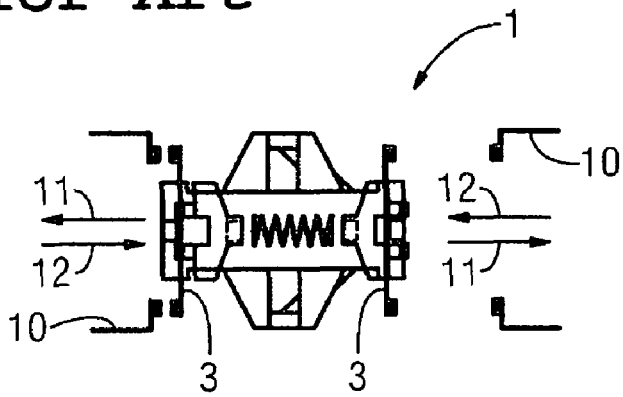
FIG 3 Prior Art

A known contact system 1 according to the prior art is shown by FIGS. 1 to 3. As the contact carrier region 2 depicted in FIG. 1 illustrates, in this case the moving contact 3 is mounted and/or positioned with its two switch pieces 4 fitted at the ends on a contact holder 5. The contact holder 5 is held in position by a metal spring 6 which, as a bridge spring, simultaneously produces the connection with the identically constructed opposite contact mechanism. The contact carrier region 2 is used in this case for mounting and positioning the movable contacts 3 and for applying the contact forces.

The jump system 7 illustrated in FIG. 2 includes, firstly, a frame 8 (switch piece carrier) for mounting the contact carrier region 2 and the metal spring 6 and, secondly, guided sprung elements 9 (nipple and nipple springs not depicted in detail). In the event of actuation of the contact 1 by a drive or actuating element, the moving contact 3 is moved in the contact-making direction 11 toward a fixed contact 10, the switch pieces 4 of the moving contact 3 and of the fixed contact 10 meeting one another in a defined way.

FIG. 3 shows a view of an assembled contact system 1 according to the prior art. The positive opening of the contact can in this case be ensured only by complicated mechanisms since, in jump mechanisms known from the prior art, the actuating direction 11 acts counter to the opening direction 12 of the contact which is closed when in the rest state. The positive opening can thus be carried out only by deflecting the actuating force, for example by way of one or more positive opening pawls.

Figure 4:
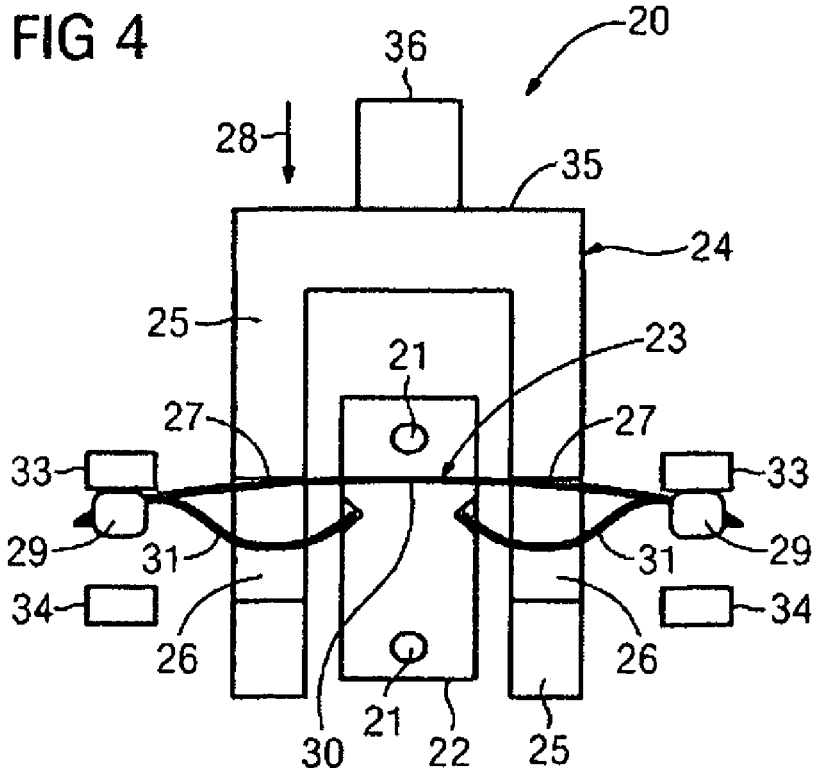
FIG. 4 shows a contact system according to an embodiment of the invention in a first switching position.

A contact system 20 according to an embodiment of the invention is illustrated in FIG. 4. It substantially includes a spring holder (bearing block) 22 which is arranged centrally and firmly connected via connecting elements 21 to a housing or the like, a contact element 23 in the manner of a contact bridge mounted on the spring holder 22, and an actuating element 24 in the manner of a slider actuating the contact element 23. The contact element 23 is fabricated from an elastic material.

The actuating element 24, which is arranged to be movable in relation to the spring holder 22, is of substantially U-shaped design. Here, apertures 26 are provided in the U-shaped arms 25, on whose walls 27 the contact element 23 rests when in the switching positions in such a way that, as a result of actuation of the actuating element 24 in the actuating direction 28 or in the opposite direction, the actuating region 30 having contact pieces 29 at its two ends and reaching through the apertures 26 on both sides of the actuating element 24 is carried along from a first switching position into a second switching position, while the contact element 23, with its two spring regions 31 integrally molded on close to the free ends of the actuating region 30 and pointing toward each other in the direction of the spring holder 22, is mounted in the bearing points 32 of the spring holder 22.

Figure 5:
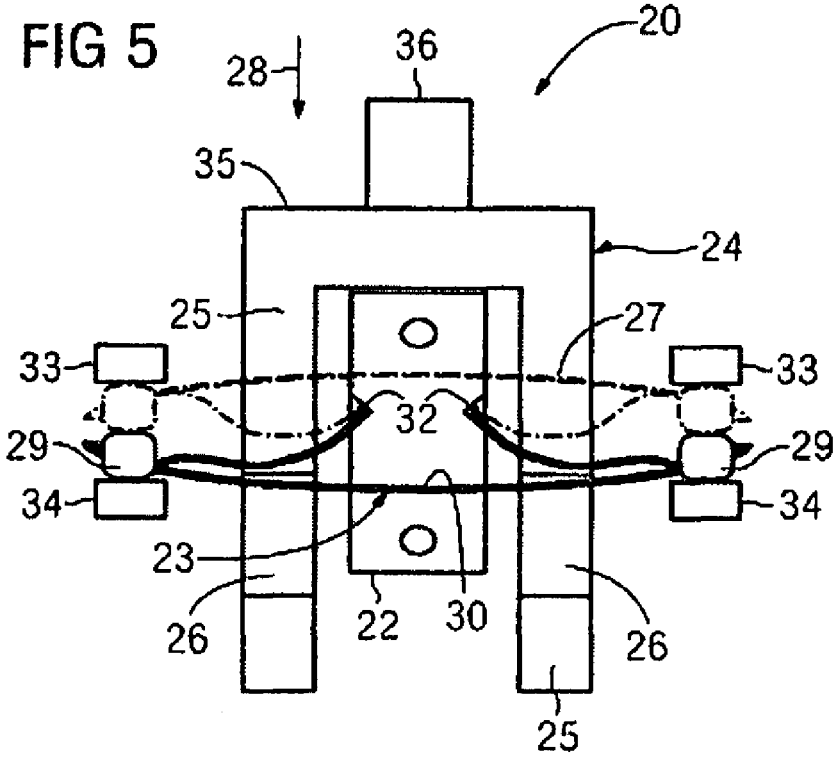
FIG. 5 shows a contact system according to an embodiment of the invention in a second switching position.
Figure 6:
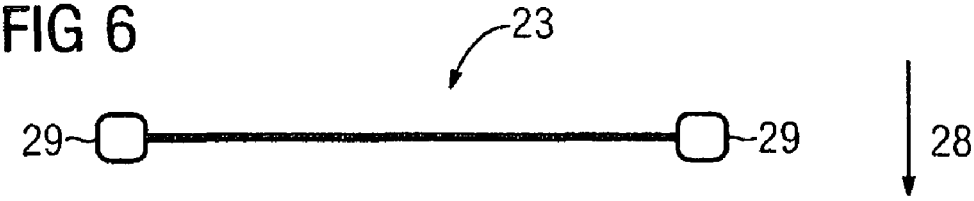
FIGS. 6-10 show side views of various embodiments of a contact element.

In other words, as a result of moving the slider 24 in the actuating direction 28, the contact system 20 can be changed from the first switching position depicted in FIG. 4, in which the contact pieces rest on the upper contact pair 33, into a second switching position, as depicted in FIG. 5, in which the contact pieces rest on the lower contact pair 34. Of course, the spring regions 31 can also be shaped in another way, for example pointing outward away from each other.

A return compression spring (not depicted) is fitted to the actuating element 24 and guides the actuating element 24 back into its initial position again as soon as the latter is no longer being actuated.

The embodiment shown here is distinguished by its symmetrical construction having double-interrupting contacts 33, 34. By way of the constructional design of the jump system, opening of the contact 20, which is closed in the non-actuated state, in the actuating direction 28 is possible. This permits reliable positive opening of the contact 20 without an additional component. The positive opening pawls known from the prior art are dispensed with. The risk of damage to or of failure of the positive opening pawl, which is difficult to test, is thus ruled out.

The contact system 20 according to an embodiment of the invention is also distinguished by the fact that moving and fixed contacts 29, 33, 34 also execute a horizontal relative movement in relation to one another during the switching operation. This counteracts tarnishing of the contact surfaces, that is to say an increase in the contact resistance or interruption of the contact by tarnishing layers. A specific arrangement of guides and mountings, as is known in systems known from the prior art, in order to produce such a relative movement by way of complicated constructional measures, is not necessary.

Bridge springs or nipple springs made of metal, such as are required in conventional contact systems, are not used here. This leads to a significant reduction in the necessary overall space for the subassembly, while complying with the air and creep gaps required in standards and regulations.

The constructionally simple design results in comparatively simple handling of the contact element 23 during fabrication and assembly. In particular, the complicated manual assembly of the metal springs is dispensed with.

Erroneous positions of the contact element, such as are present in conventional contact systems on account of the multifarious bearing points having a plurality of degrees of freedom between bridge spring and movable contact bridge and in the case of indirect mounting between spring and movable contact holder, can be reduced decisively and associated functional impairment can thus be avoided.

The contact system 20 according to an embodiment of the invention ensures opening or closing of the contact without delay. In the case of single-pole or two-pole systems, immediate actuation, that is to say immediate opening or closing of all the contacts present, is ensured. The switching operation is irreversible until there is a further actuation of the actuating element 24. After the jump point has been reached, it proceeds automatically.

As a result of the special constructional configuration of the contact system 20, mounting of the actuating element 24 is ensured in such a way that the switch pieces of the moving and of the fixed contact 29, 33, 34 meet one another in a defined manner. In this case, compensation of the contact erosion is ensured by means of an appropriate constructional shape of the contact element 23. When the contact is closed, the contact element 23 applies a defined contact force. On account of the construction chosen, geometrically particularly exactly determinable switching points, at which one or two contacts are opened or closed, can be maintained. The actuation of the switching mechanism is in this case carried out mechanically. Thus, the actuating element 24 has on the base 35 of its U a part 36 which leads to the actual actuating member, for example a drive head or a knob. Of course, the actuating element 24 itself can also be used as an actuating member.

Figure 7:
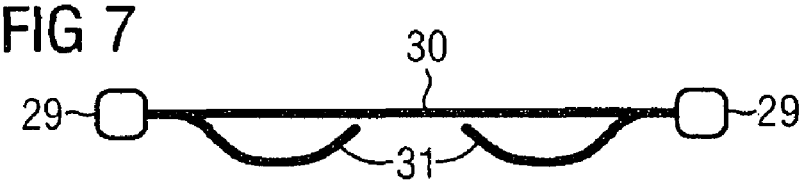
Figure 8:
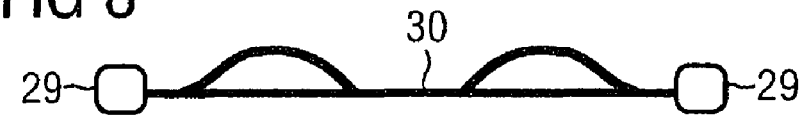
Figure 9:
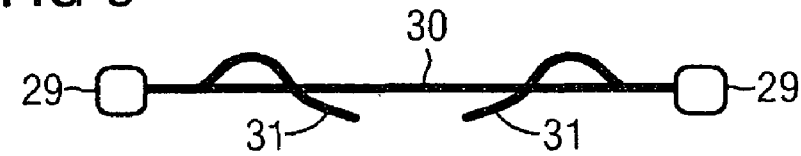
Figure 10:
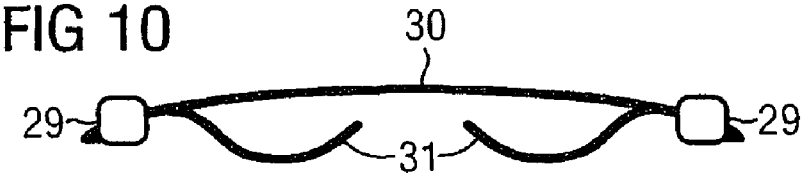

In FIGS. 6 to 10, contact elements 23 are depicted in the unmounted state. The actuating region 30 can in this case be designed without pre-embossing in the unmounted state, as depicted in FIGS. 6 to 9. However, as illustrated in FIG. 10, it can also have an impressed pre-embossing. Likewise, the spring regions 31 can be designed without pre-embossing, see FIG. 6, or else have pre-embossing. FIG. 7 shows once more the contact element 23 already known from FIGS. 2 and 3. The spring regions 31 of the contact element 23 are in this case pre-embossed on one side, specifically in the actuating direction 28. They therefore have a preferential position, so that an asymmetrical jump behavior results. The contact element 23 illustrated in FIG. 8 has no pre-embossing, while the contact element 23 illustrated in FIG. 9 exhibits embossing on both sides. If preferred jump directions are provided, the remaining components of the contact system, in particular the return spring of the actuating element 24, can be adapted and dimensioned appropriately.

The forms shown in FIGS. 6 to 10 merely represent possible example embodiments. What is common to all of them is the comparatively simple shape and the simple production possible as a result. In principle, the contact elements 23 can assume any desired forms. However, they must be formed in such a way that, during assembly, stressing of the spring regions 31 takes place, so that an adequate contact force can be applied to the contact pieces 29. During assembly, the sprung regions are deformed and assume a force-optimal shape. If spring regions 31 and/or actuating region 30 are pre-embossed, the jump characteristics can be optimized.

If the spring regions 31 have no prestress when assembled, they are preferably used in conjunction with a slow-motion device. In this case, in other words no jumping from one contact position into another contact position takes place.

Figure 11:
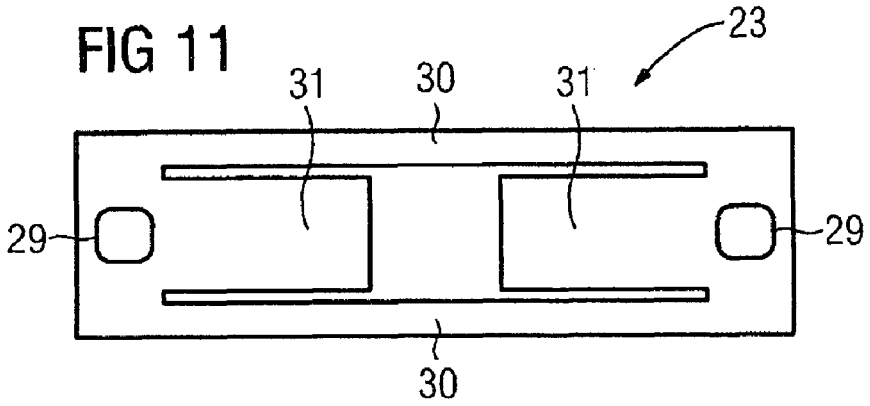
FIGS. 11, 12 show plan views of embodiments of a contact element with an inner spring region.
Figure 12:
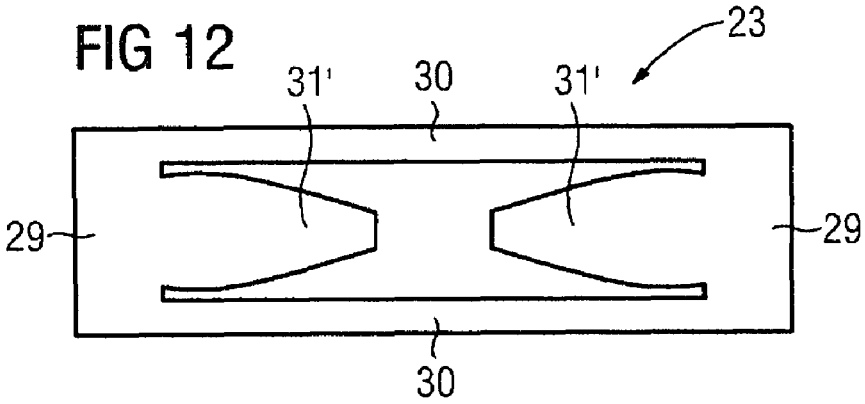

The contact element 23 has a substantially rectangular shape in plan view. However, other shapes are in principle also possible. The shape of the spring regions 31 mounted in the bearing points 32 of the spring holder 22 can be varied, as depicted in FIGS. 11 and 12. The sprung regions 31 in this case extend toward one another from the end regions of the contact element 23 having the contact pieces 29 in the direction of the contact bridge center and are formed in the manner of tongues. In order to absorb the high mechanical stresses at the instant of the jump as well as possible, the shape of the spring regions 31 can vary. For example, FIG. 11 shows a contact element 23 having spring regions 31 of rectangular shape, while the spring regions 31' of the contact element 23 depicted in FIG. 12 taper in the direction of the spring holder 22.

Figure 13:
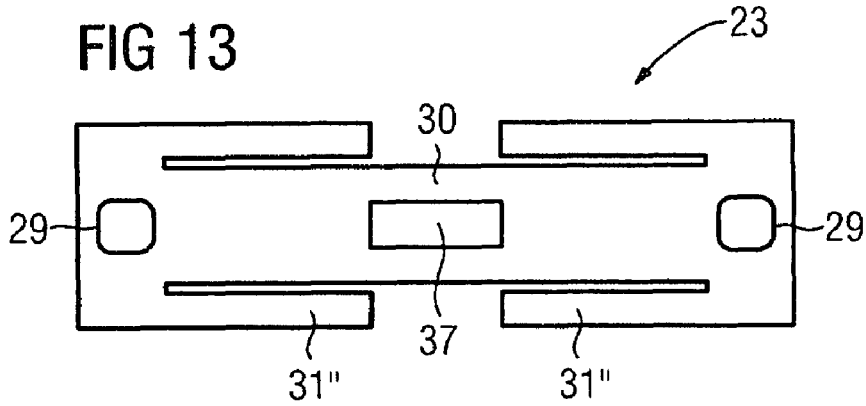
FIGS. 13, 14 show plan views of a contact element with an outer spring region.
Figure 14:
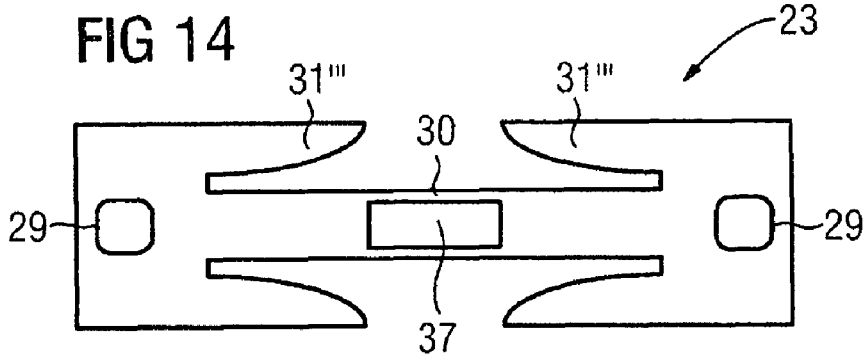

While the contact elements 23 shown in FIGS. 10 and 11 have inner spring regions 31, the spring regions 31 in the contact bridges 23 depicted in FIGS. 13 and 14 are located on the outside. In other words, two symmetrically arranged pairs of spring regions flank the centrally arranged actuating region 30 there. The latter has a central opening 37, which serves as an access opening for fixing the actuating element 24. In other words, the actuating element 24 is enclosed in the opening 37; thus the contact element 23 can both be transferred from one switching position to another and also fetched back. The spring regions 31 in this embodiment are mounted on an external housing (not depicted) which, for this purpose, has appropriately molded bearing points. Two spring holders arranged on both sides of the actuating region as special components are thus not required. In this case, the shape of the spring regions 31 can also vary. For instance, as shown in FIG. 13, rectangular spring regions 31" or else, as shown in FIG. 14, dovetail-shaped spring regions 31''' can be used.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A contact system, comprising:

fixed contact pieces;

a spring holder;

an actuating element having a pair of symmetrical arms extending from a base portion and an aperture in each arm; and a moving contact element, including a spring region mounted on the spring holder to provide a jump function, an actuating region that passes through the apertures, actuatable by the actuating element to initiate the jump function, and a contact-making region for the simultaneous production of an electric contact with the fixed contact pieces.

2. The contact system as claimed in claim 1, wherein the actuating element is enclosed in the moving contact element.

3. The contact system as claimed in claim 2, wherein the actuating element is enclosed in a central opening in the moving contact element.

4. The contact system as claimed in claim 3, wherein the actuating region of the moving contact element is arranged centrally.

5. The contact element as claimed in claim 4, wherein the contact element is produced from at least one of an elastically deformable material and material composite.

6. The contact system as claimed in claim 5, wherein the spring holder is formed as part of a housing, enclosing the contact element.

7. The contact system as claimed in claim 6, wherein spring regions are pre-embossed in order to achieve at least one of improved jump characteristics and an asymmetrical jump behavior.

8. The contact system as claimed in claim 2, wherein the actuating region of the moving contact element is arranged centrally.

9. The contact element as claimed in claim 2, wherein the contact element is produced from at least one of an elastically deformable material and material composite.

10. The contact system as claimed in claim 1, wherein the actuating element is enclosed in a central opening in the moving contact element.

11. The contact system as claimed in claim 1, wherein the actuating region of the moving contact element is arranged centrally.

12. The contact element as claimed in claim 1, wherein the contact element is produced from at least one of an elastically deformable material and material composite.

13. The contact system as claimed in claim 1, wherein the spring holder is formed as part of a housing, enclosing the contact element.

14. The contact system as claimed in claim 1, wherein spring regions are pre-embossed in order to achieve at least one of improved jump characteristics and an asymmetrical jump behavior.

15. The contact system as claimed in claim 1, wherein the spring region of the moving contact element is arranged as an outer region.

* * * * *